United States Patent [19]

Weatherby

[11] 4,369,004

[45] Jan. 18, 1983

[54] EARTH RETAINING METHOD AND STRUCTURE

[75] Inventor: David E. Weatherby, Rockville, Md.

[73] Assignee: Schnabel Foundation Company, Washington, D.C.

[21] Appl. No.: 192,695

[22] Filed: Oct. 1, 1980

[51] Int. Cl.[3] ..... E02D 29/00

[52] U.S. Cl. ..... 405/262; 405/258; 405/284

[58] Field of Search ..... 405/258, 262, 284, 285, 405/286, 287, 273–283

[56] References Cited

U.S. PATENT DOCUMENTS

| | | | |
|---|---|---|---|
| 1,739,108 | 12/1929 | Weber | 405/262 |
| 1,747,038 | 2/1930 | Weber . | |
| 1,761,614 | 6/1930 | Collier . | |
| 1,933,483 | 10/1933 | Pennoyer . | |
| 2,000,492 | 5/1935 | McKeen | 405/262 |
| 2,045,112 | 6/1936 | Upson | 405/262 |
| 2,110,253 | 3/1938 | Nedden . | |
| 3,250,075 | 5/1966 | Webb et al. | 405/262 |
| 3,381,479 | 5/1968 | Curzio | 405/150 |
| 3,412,562 | 11/1968 | Doughty . | |
| 3,438,207 | 4/1969 | Turzillo | 405/287 |
| 3,490,242 | 1/1970 | Schnabel . | |
| 3,555,830 | 1/1971 | York | 405/285 |
| 3,638,435 | 2/1972 | Mason | 405/262 |
| 3,802,204 | 4/1974 | Mason . | |
| 3,999,392 | 12/1976 | Fukushima . | |
| 4,055,927 | 11/1977 | Tamaro | 405/287 X |

FOREIGN PATENT DOCUMENTS

| | | | |
|---|---|---|---|
| 2233857 | 1/1975 | France | 405/262 |

*Primary Examiner*—Dennis L. Taylor

*Attorney, Agent, or Firm*—Schuyler, Banner, Birch, McKie and Beckett

[57] ABSTRACT

A tied back retaining wall structure is disclosed comprising channel-shaped sheet piles, a reinforcing bar matrix and a concrete wall encasing the matrix and filling the channels of the piles. The reinforcing bar matrix comprises an array of laterally disposed reinforcing bars which span the spaces between the piles. Headed studs welded to the piles insure a secure connection of the wall to the piles. A method of constructing such a wall is disclosed which comprises excavating downwardly in stages after installing sheet piling in the ground, erecting a reinforcing bar matrix and pouring or spraying concrete over the structure to form the finished wall.

21 Claims, 12 Drawing Figures

EARTH RETAINING METHOD AND STRUCTURE

BACKGROUND OF THE INVENTION

1. Field of the Invention

The present invention relates generally to the field of earth retaining structures and, more particularly, to a retaining wall structure and a method of constructing the same.

2. Description of the Prior Art

Tied back retaining walls for retaining an earthen mass typically incorporate wall sections of reinforced concrete, precast concrete members, a combination of steel piles and precast members, or steel piles and cast-in-place concrete. The steel piles used in these types of structures are commonly known as "soldier beams" or "soldier piles," and they are normally H or I-shaped in cross-section. Such structures and the methods for their erection are exemplified in Webb U.S. Pat. No. 3,250,075, which discloses a method and structure utilizing solider beams and cast-in-place concrete.

There are several disadvantages inherent in the use of H or I-shaped soldier beams for these types of structures. The connections between the tiebacks and the soldier beams are often complex. In addition, where reinforcing rods are to be embedded in a cast-in-place concrete wall, their connections with the solider beams are often complex and costly.

SUMMARY OF THE INVENTION

Accordingly, it is an object of the present invention to obviate the above-noted disadvantages of the prior art by providing a method of constructing a retaining wall which is simple and economical to perform.

Another object of the invention is to provide a retaining wall which incorporates preferred sheet pile soldier beams in a tied back, cast-in-place concrete wall structure.

Another object of the invention is to provide such a structure wherein the connections between the tiebacks and the wall are relatively simple and easily made.

Another object of the invention is to provide such a structure incorporating reinforcing bars wherein the concrete wall and embedded reinforcing bars are simply and easily connected to the sheet piles and the remainder of the wall structure.

These and other objects of the present invention are accomplished by providing a method of constructing a wall for retaining an earthen mass which involves installing a pluralitty of laterally spaced sheet piles in the ground along the predetermined position of the wall to be constructed. A first stage of earth are excavated adjacent to the piles and the earthen mass to a depth above the bottom of the earthen mass. Temporary earth retaining means are installed as needed between the piles against the exposed face of the earthen mass. A plurality of tiebacks are installed and anchored in the earthen mass, and these are connected to the piles. The above excavating, temporary retaining and tieback installing steps are then repeated sequentially in descending stages for the full height of the earthen mass. A matrix of reinforcing bars is then placed adjacent to the piles and the temporary earth retaining means, wall forms are erected adjacent to the reinforcing bars, and concrete is poured between the forms and the piles and the temporary retaining means to encase the reinforcing bars and form a permanent tied back wall.

Instead of casting the entire concrete wall in one step, the permanent wall may be constructed in stages. This is accomplished by a mwethod comprising the identical steps of installing sheet piles, excavating a first stage of earth and installing tiebacks in the first stage. At this point, however, a matrix of reinforcing bars is placed adjacent to the piles and the earthen mass and wall forms are erected and filled with concrete to encase the reinforcing bars of the first stage and form a portion of the permanent tied back wall. These excavating, tieback installing, reinforcement placing, from erecting and concrete pouring steps are then repeated sequentially in descending stages for the full height of the earthen mass to complete the wall.

A variation on this stage-wise construction involves similar steps of installing sheet piles, excavating, installing tiebacks and placing a matrix of reinforcing bars for each stage. However, no forms are required because gunite or shotcrete is applied to the piles and the earthen mass at each stage to encase the reinforcing bars and form a portion of the permanent wall, these steps being repeated sequentially in descending stages for the full height of the earthen mass to complete the wall.

Hence, a retaining wall constructed according to the invention will comprise a plurality of laterally spaced sheet piles having a channel-shaped cross-section installed adjacent to the earthen mass retained, a plurality of tiebacks anchored in the earthen mass and connected to the piles, a reinforcing bar matrix adjacent to the retained face of the earthen mass and the piles, a wall of concrete encasing the reinforcing bar matrix and extending across the piles and the retained face of the earthen mass, and achoring means for anchoring the concrete wall and the encased reinforcing bar matrix to the piles. The piles are installed with their convex surfaces disposed against the earthen mass, and may be made up of pairs of adjacent interlocked pile segments. The tieback heads extend through the piles and are connected thereto by standard hardware in the concave channel portions thereof, the concrete completely filling the concave channel portions and encasing the tieback heads. The anchoring means may comprise a plurality of headed studs secured to the piles and encased in the concrete.

BRIEF DESCRIPTION OF THE DRAWINGS

The novel features of the invention are set out with particularity in the appended claims, but the invention will be understood more fully and clearly from the following detailed description of preferred embodiments of the invention as set forth in the accompanying drawings, in which:

DESCRIPTION OF PREFERRED EMBODIMENTS

Figure 1:
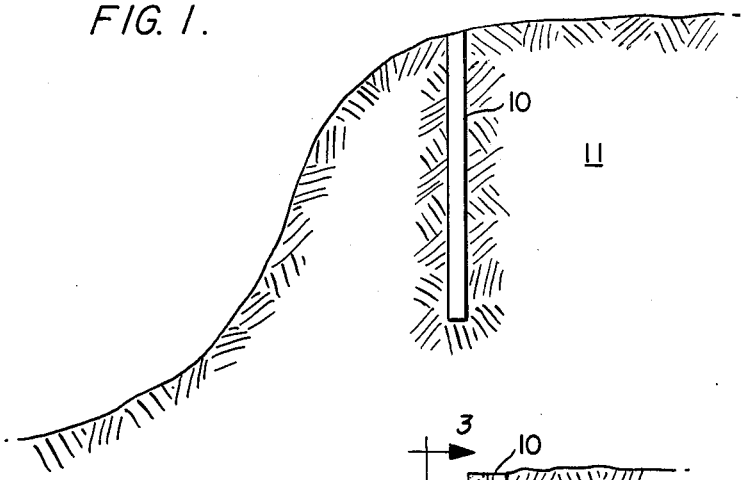
FIG. 1 is a side sectional view of an earthen mass to be retained showing one of several sheet piles in position prior to excavation.
Figure 2:
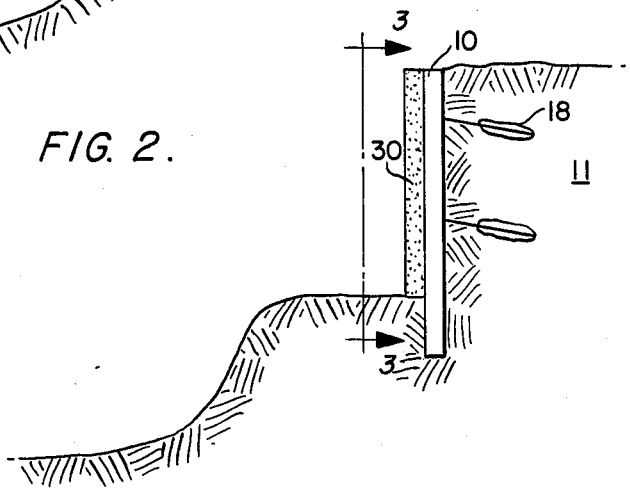
FIG. 2 is a view similar to FIG. 1 showing the completed structure.
Figure 3:
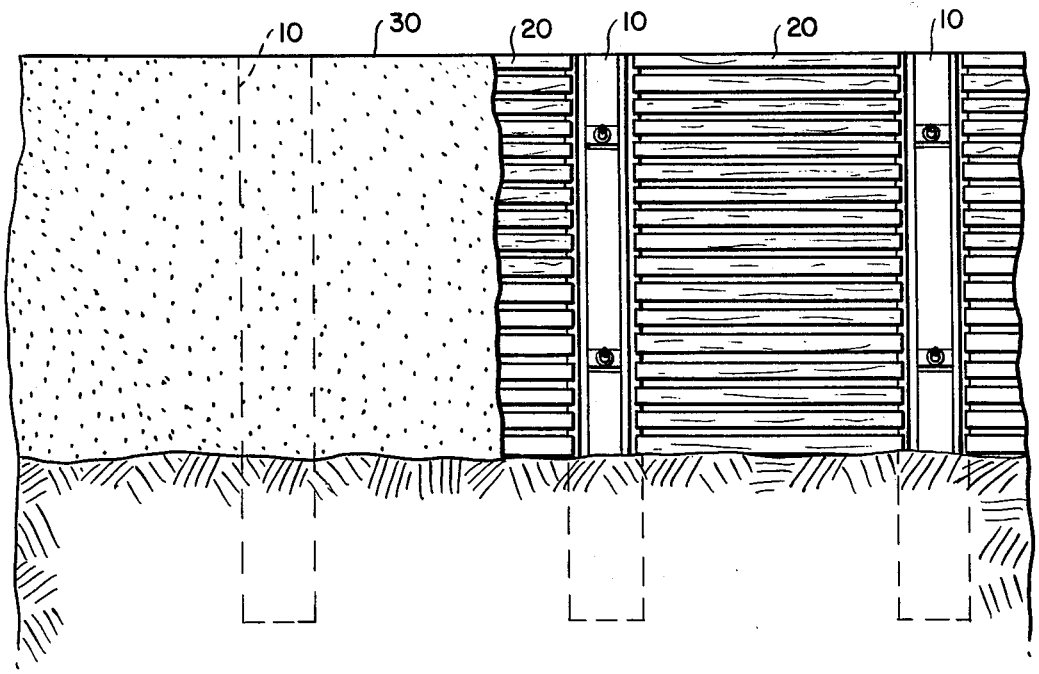
FIG. 3 is an elevational view of the wall of FIG. 2, partly in section, taken along line 3—3.
Figure 4:
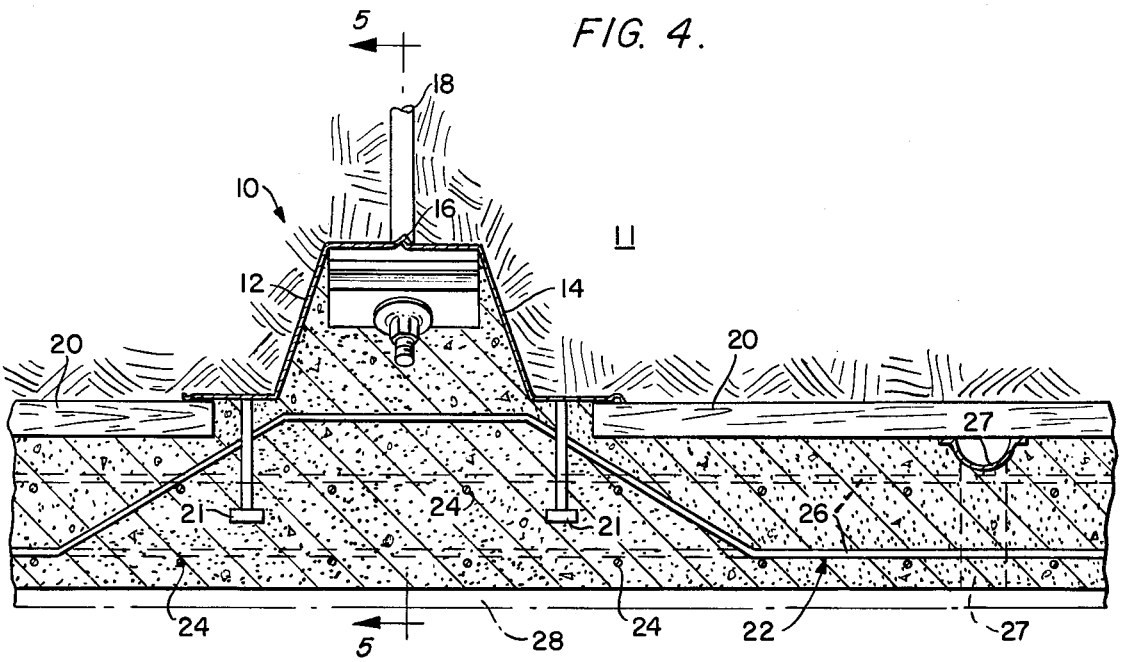
FIG. 4 is a sectional plan view of the same showing the interrelationship of a sheet pile, tieback head, reinforcing matrix and concrete wall.
Figure 5:
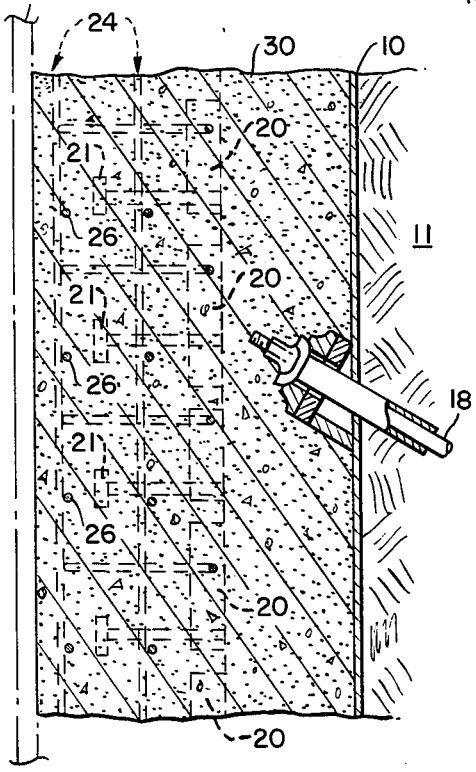
FIG. 5 is a sectional view of the same taken along line 5—5 of FIG. 4.

Referring to FIGS. 1–5, a retaining wall according to the invention is constructed by first installing a plurality of sheet piles 10 into the ground at laterally spaced locations along the future face of an earthen mass 11 to be retained. A typical spacing is 13 feet on center, but this spacing may be varied in accordance with sound engineering practices. Sheet piles 10 are channel-shaped in cross-section and may be made up of pairs of interlocking steel pile segments 12 and 14 which are joined together along seam 16. Piles 10 may be installed in the ground either vertically or on a batter in any conventional manner, such as by means of a pile driver or by being inserted into predrilled holes in the ground, and are oriented with their convex surfaces disposed against earthen mass 11. Piles 10 are installed at least as deep as the predetermined bottom of earthen mass 11. Preferably, the piles are installed below the bottom of the earthen mass so as to provide additional stability for the wall.

After the piles have been installed, excavation is commenced to a depth above the bottom of earthen mass 11. This depth coincides with a depth of excavation for which tiebacks are required for stability. At this point, a first level of tiebacks 18 is installed and anchored in the earthen mass. Any type of tieback may be used, but a tieback of the corrosion protected type is preferred for long lasting strength and integrity. One such type of tieback is disclosed in Weatherby U.S. Pat. No. 4,124,983. The tie rods of the tiebacks extend through the sheet piles, and are connected thereto with standard hardware, such as that described in Schnabel U.S. Pat. No. 3,490,242.

Temporary earth retaining means are then installed between the piles against the exposed face of earthen mass 11 as needed during excavation in order to prevent the earthen mass from collapsing. Such temporary retaining means may comprise conventional lagging 20. Alternatively, the exposed face of the earthen mass between piles 10 may be coated with a thin layer of gunite or shotcrete to achieve this same object. Headed studs 21 are welded to the flanges of piles 10. The purpose of these studs is explained below.

These excavating, temporary retaining and tieback installing steps are repeated sequentially in descending stages for the full height of earthen mass 11. When the bottom of the earthen mass has been reached, a matrix of reinforcing bars 22 is placed adjacent to piles 10 and earthen mass 11. Matrix 22 comrises an array of laterally disposed reinforcing bars 26 spanning the spaces between piles 10, and vertically disposed reinforcing bars 24. Bars 26 are angled back in the vicinity of piles 10 to pass behind the heads of studs 21. Conventional drainage pipes 27 may be placed at this time.

Figure 6:
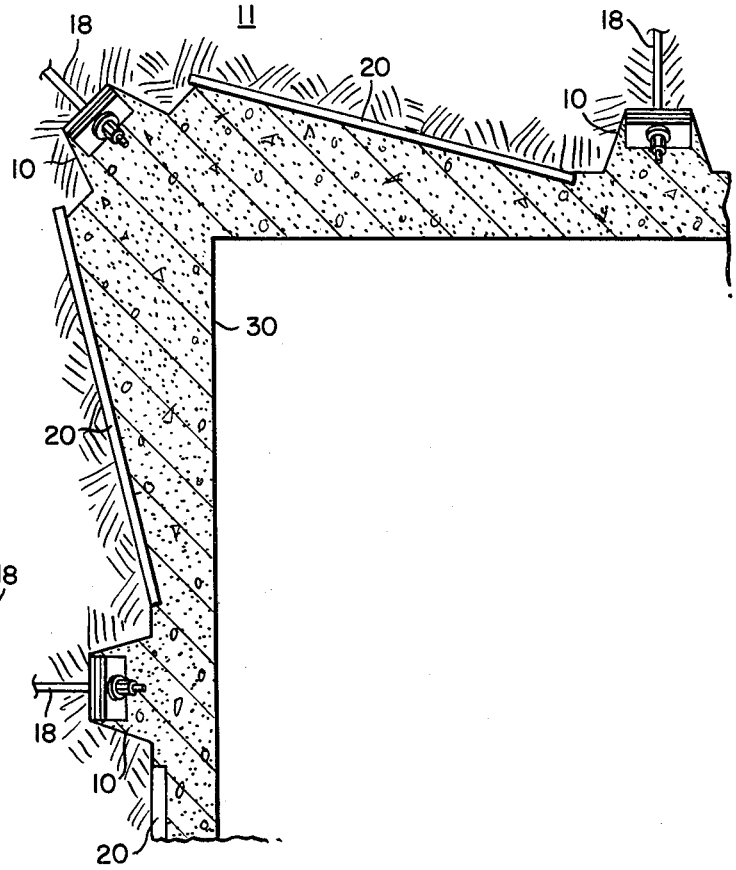
FIG. 6 is a plan view of a corner section of a wall constructed according to the invention.

After the reinforcing bar matrix has been placed, wall forms 28 are erected adjacent to the matrix and concrete 30 is poured between forms 28 and piles 10 and lagging 20 to completely encase reinforcing bar matrix 22, headed studs 21 and the tieback heads, and form the finished, permanent wall. After the concrete has set the forms may be stripped away. Headed studs 21 securely anchor the concrete and its encased reinforcing bar matrix 22 to piles 10. A corner section of a wall constructed according to the invention is illustrated in FIG. 6.

The deep-dish sheet pile sections, filed with concrete, form stable vertical beams which impart vertical rigidity to the retaining wall. Lateral rigidity is enhanced by the laterally disposed reinforcing bars 26. Such a wall structure need not exceed approximately 12 inches in thickness, irrespective of the height of the wall. Compared to cantilevered retaining walls, which require the construction of a temporary retaining wall first, the retaining wall according to the invention is a permanent structure which is constructed all at once. It is therefore less expensive to construct than cantilevered retaining walls, especially high walls requiring counterforts. And the finished surface of the retaining wall according to the invention is just as smooth and uninterrupted as that of a cantilevered wall, because the tiebacks heads are totally encased in the concrete.

Figure 7:
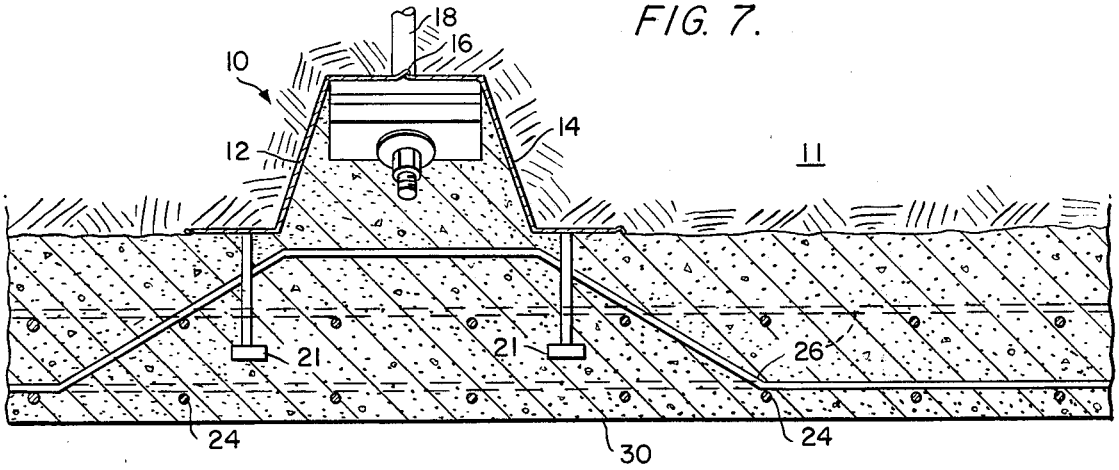
FIG. 7 is a view similar to FIG. 4 showing an alternative embodiment of the invention.
Figure 8:
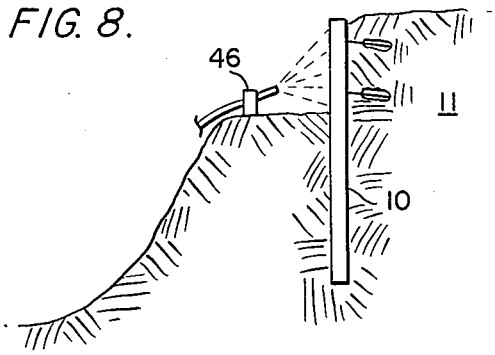
FIG. 8 is a schematic illustration showing one step in the construction of the wall illustrated in FIG. 7.
Figure 9:
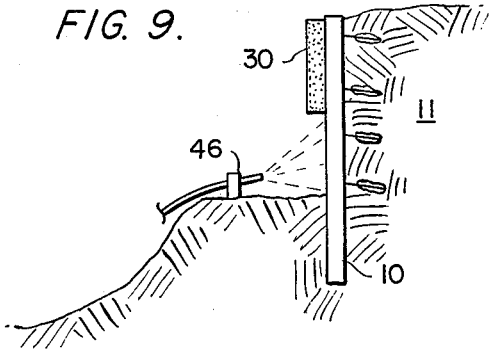
FIG. 9 is a schematic of a subsequent step in the construction of the same.

An alternative method of construction is illustrated in FIGS. 7, 8 and 9. In this method, the pile installing, first stage excavating and tieback installing steps of the above-described method are identical. However, a first stage matrix of reinforcing bars is placed adjacent to piles 10 and earthen mass 11 and gunite or shotcrete is applied by suitable equipment 46 (see FIG. 8) to completely encase the reinforcing matrix and the headed studs and form a portion of the finished, permanent tied back wall. Temporary earth retaining means, such as a thin layer of gunite, may be used if required. Of course, using this method of concrete placement, wall forms are not required. After the first stage has been completed, excavating, tieback installing, reinforcing bar placing and gunite applying is performed sequentially in descending stages (see FIG. 9) for the full height of the earthen mass to complete the wall. The wall shown in FIG. 7 is constructed according to this method. If required, conventional drainage pipes (not shown) may be installed in each stage before applying the concrete.

Figure 10:
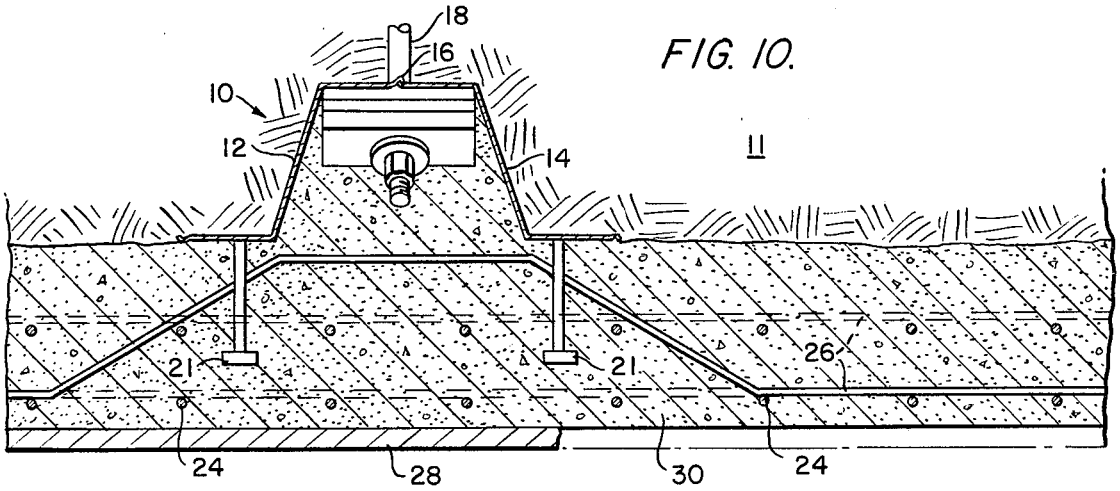
FIG. 10 is a view similar to FIG. 4 showing an alternative embodiment of the wall.
Figure 11:
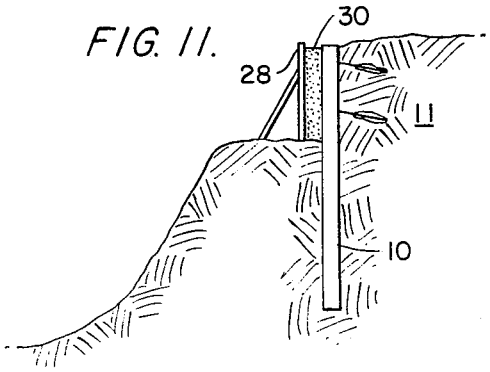
FIG. 11 is a schematic view showing one stage in the construction of the wall illustrated in FIG. 10.
Figure 12:
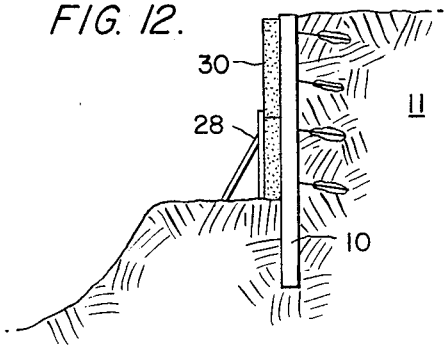
FIG. 12 is a schematic view showing a subsequent stage in the construction of the same.

Another alternative method of constructing the retaining wall according to the invention is illustrated in FIGS. 10, 11 and 12. In this method, the pile installing, first stage excavating, tieback installing and reinforcing bar matrix placing steps are identical to those of the first method. At this stage, however, wall forms 28 are erected and concrete is poured to form a portion of the finished, permanent, tied back wall (see FIG. 11). Excavating, tieback installing, reinforcement placing, form erecting and concrete pouring are repeated sequentially in descending stages (see FIG. 12) for the full height of the earthen mass to complete the wall. If conventional drainage pipes (not shown) are required, these may be installed in each stage before erecting the wall forms.

Although the present invention has been illustrated in terms of a preferred embodiment, it will be obvious to one of ordinary skill that numerous modifications may be made without departing from the true spirit and scope of the invention which is to be limited only by the appended claims.

I claim:

1. A method of constructing a wall for retaining an earthen mass comprising the steps of:

installing a plurality of laterally spaced sheet piles in the ground along the predetermined position of the wall to be constructed;

excavating a first stage of earth adjacent to said piles and said earthen mass to a depth above the bottom of said earthen mass;

installing temporary earth retaining means between said piles against the exposed face of said earthen mass;

installing and anchoring a plurality of tiebacks in said earthen mass, and connecting said tiebacks to said piles;

repeating the above excavating, temporary retaining and tieback installing steps sequentially in descending stages for the full height of said earthen mass;

placing a matrix of reinforcing bars adjacent to said piles and said temporary earth retaining means;

erecting wall forms adjacent to said reinforcing bars; and pouring concrete between said forms and said piles and temporary retaining means to encase said reinforcing bars and form a permanent tied back wall.

2. A method according to claim 1 wherein said temporary earth retaining means comprises lagging.

3. A method according to claim 1 wherein said temporary earth retaining means comprises gunite.

4. A method of constructing a wall for retaining an earthen mass comprising the steps of:

installing a plurality of laterally spaced sheet piles in the ground along the predetermined position of the wall to be constructed;

excavating a first stage of earth adjacent to said piles and said earthen mass to a depth above the bottom of said earthen mass;

installing and anchoring a plurality of tiebacks in said earthen mass, and connecting said tiebacks to said piles;

placing a matrix of reinforcing bars adjacent to said piles and said earthen mass;

applying gunite to said piles and said earthen mass to encase said reinforcing bars and form a portion of a permanent tied back wall; and repeating the above excavating, tieback installing, reinforcement placing and gunite applying steps sequentially in descending stages for the full height of said earthen mass to complete the wall.

5. A method according to claim 4 further comprising the step of applying a thin layer of gunite to said piles and the exposed face of said earthen mass at each stage before installing said tiebacks to temporarily retain the earth.

6. A method of constructing a wall for retaining an earthen mass comprising the steps of:

installing a plurality of laterally spaced sheet piles in the ground along the predetermined position of the wall to be constructed, each of said piles having a deep channel extending along substantially the full length thereof with the open side of the channel facing away from said earthen mass;

excavating a first stage of earth adjacent to said piles and said earthen mass to a depth above the bottom of said earthen mass;

installing and anchoring a plurality of tiebacks in said earthen mass, and connecting said tiebacks to said piles;

placing a matrix of reinforcing bars adjacent to said piles and said earthen mass;

erecting wall forms adjacent to said reinforcing bars;

pouring concrete between said forms and said earthen mass to encase said reinforcing bars and fill the exposed portion of the channel of each pile, thereby forming a portion of a permanent tied back wall having vertical beams at the locations of said piles; and repeating the above excavating, tieback installing, reinforcement placing, form erecting and concrete pouring steps sequentially in descending stages for the full height of said earthen mass to complete the wall.

7. A method according to claim 6 further comprising the step of installing temporary earth retaining means between said piles against the exposed face of said earthen mass at each stage before installing said tiebacks.

8. A method according to claim 1, 4 or 6 wherein said tiebacks are of the corrosion-protected type.

9. A retaining wall structure for retaining an earthen mass comprising:

a plurality of laterally spaced sheet piles installed adjacent to the earthen mass retained, each of said piles having a deep channel extending along substantially the full length thereof with the open side of the channel facing away from said earthen mass;

a plurality of tiebacks anchored in said earthen mass and connected to said piles;

a reinforcing bar matrix adjacent to the retained face of said earthen mass and said piles;

a wall of concrete encasing said reinforcing bar matrix, filling the channels of said piles to form vertical beams at the pile locations, and extending across said piles and the retained face of said earthen mass; and anchoring means for anchoring said concrete wall and said encased reinforcing bar matrix to said piles.

10. A wall according to claim 9 wherein said piles comprise pairs of adjacent interlocked pile segments which together form said channel-shaped cross-section.

11. A wall according to claim 9 wherein the heads of said tiebacks extend through said piles and are connected thereto in said channels, the concrete completely filling said channels and encasing said tieback heads.

12. A wall according to claim 9 wherein said reinforcing bar matrix comprises an array of laterally disposed reinforcing bars spanning the spaces between said piles.

13. A wall according to claim 9 or 12 wherein said anchoring means comprises a plurality of headed studs secured to said piles with their headed ends projecting away from said earthen mass, said wall of concrete also encasing said studs.

14. A wall according to claim 13 wherein said lateral reinforcing bars pass between said headed ends and said piles.

15. A method according to claim 1 wherein each of said piles has a deep channel extending along substantially the full length thereof with the open side of the channel facing away from said earthen mass.

16. A method according to claim 4 wherein each of said piles has a deep channel extending along substantially the full length thereof with the open side of the channel facing away from said earthen mass.

17. A method according to claim 6, 15 or 16 wherein said piles comprise pairs of adjacent interlocked pile segments which together form said channels.

18. A method according to claim 6, 15 or 16 wherein the heads of said tiebacks extend through said piles into said channels, the concrete completely filling said channels and encasing said tieback heads.

19. A method according to claim 18 wherein said wall is anchored to said piles.

20. A method according to claim 19 wherein said matrix of reinforcing bars comprises an array of laterally disposed reinforcing bars spanning the spaces between said piles.

21. A method according to claim 20 wherein a plurality of headed studs are secured to said piles with their headed ends projecting away from said earthen mass, and said lateral reinforcing bars pass between said headed ends and said piles.

* * * * *